United States Patent [19]

Dieckelmann et al.

[11] 3,957,426

[45] May 18, 1976

[54] FATTY ACID ESTER MIXTURES LIQUID AT LOW TEMPERATURES AND PROCESS

[75] Inventors: Gerhard Dieckelmann, Hilden; Helmut Hartmann, Langenfeld; Jurgen Plapper, Hilden, all of Germany

[73] Assignee: Henkel & Cla G.m.b.H., Dusseldorf, Germany

[22] Filed: Mar. 21, 1975

[21] Appl. No.: 560,333

Related U.S. Application Data

[62] Division of Ser. No. 446,680, Feb. 28, 1974, Pat. No. 3,910,972.

[30] Foreign Application Priority Data

Mar. 8, 1973 Germany ..... 2311344

[52] U.S. Cl. ..... 8/94.23; 8/94.22; 252/8.57

[51] Int. Cl.[2] ..... C14C 9/02

[58] Field of Search ..... 8/94.23

[56] References Cited

UNITED STATES PATENTS

| | | | |
|---|---|---|---|
| 2,892,673 | 6/1959 | Heyden et al. | 8/94.23 |
| 3,485,573 | 12/1969 | Heyden | 8/94.23 |
| 3,724,999 | 4/1973 | Stein et al. | 8/94.23 |
| 3,826,610 | 7/1974 | Komarek et al. | 8/94.26 |

*Primary Examiner*—John Kight, III

*Attorney, Agent, or Firm*—Hammond & Littell

[57] ABSTRACT

Fatty acid ester mixtures liquid at low temperatures comprising (A) alkylene oxide adducts to train-oil fatty acids, or mixtures, esterified with unsaturated fatty acids, or mixtures, which are substantially free of any polyunsaturated train-oil fatty acids; or (B) alkylene oxide adducts to unsaturated fatty acids, or mixtures, which are substantially free of any polyunsaturated train-oil fatty acids, esterified with train-oil fatty acids, or mixtures; as well as compositions for using and the processes of preparing and using these esters.

10 Claims, No Drawings

FATTY ACID ESTER MIXTURES LIQUID AT LOW TEMPERATURES AND PROCESS

This is a division of Ser. No. 446,680, filed Feb. 28, 1974, now U.S. Pat. No. 3,910,972.

THE PRIOR ART

The leather industry requires as fat liquoring agents large quantities of fatty acid esters with a good softening effect, which can be used, if necessary, in partly sulfated form, and are intended to impart a soft and oily handle to the leather. For this purpose, the prior art previously used naturally occurring fatty matter, such as high quality fish oil, whale oil, or sperm oil. One disadvantage is that these fats are not always available in sufficient quantities, or have to be recovered from the natural raw materials by cumbersome refining processes, such as by cold filtration or distillation. In particular the train oils are frequently not uniform in their composition; moreover, they may be partly split into fatty acids and contaminated by separations of salts. The prior art therefore has already attempted to split train oils into the corresponding fatty acids and to manufacture from these, by re-esterification uniform and qualitatively more valuable products. This process is cumbersome, however, and does not lead to satisfactory results.

OBJECTS OF THE INVENTION

It is an object of the present invention to provide fatty acid esters mixtures liquid at low temperatures comprising (A) alkylene oxide adducts to train-oil fatty acids, or mixtures, esterified with unsaturated fatty acids, or mixtures, which are substantially free of any polyunsaturated train-oil fatty acids or (B) alkylene oxide adducts to unsaturated fatty acids, or mixtures, which are substantially free of any polyunsaturated train-oil fatty acids, esterified with train-oil fatty acids, or mixtures.

It is another object of the present invention to provide a fat-liquoring agent composition containing the above-described esters partially sulfated, as well as a method of utilizing these partially sulfated esters for fat-liquoring of leather and skins.

These and other objects of the present invention will become apparent as the description thereof proceeds.

DESCRIPTION OF THE INVENTION

The invention relates to a process for the manufacture of low-temperature resistant, liquid fatty acid esters, which can be used in particular in place of natural train oils or sperm oil in the preparation of fat liquoring agents in the leather industry.

According to the present invention, low-temperature resistant, liquid fatty acid esters with a proportion of polyunsaturated fatty acids, are characterized in that A. adducts of 1 and 10 mols of ethylene oxide and/or propylene oxide to train-oil fatty acids or liquid fatty acid mixtures containing train-oil fatty acids with a content of 10 to 60 per cent by weight of polyunsaturated fatty acids of chain lengths $C_{20}$ to $C_{24}$, are esterified with liquid fatty acids or mixtures of fatty acids with a content of more than 75 per cent by weight of mono- or di-unsaturated fatty acids of chain lengths $C_{10}$ to $C_{22}$, which are substantially free of any polyunsaturated train-oil fatty acids, or B. adducts of 1 to 10 mols of ethylene oxide and/or propylene oxide on liquid fatty acids or mixtures of fatty acids with a content of more than 75 per cent by weight of mono- or di-unsaturated fatty acids of chain lengths $C_{10}$ to $C_{22}$ which are substantially free of polyunsaturated train-oil fatty acids, are esterified with train-oil fatty acids or with mixtures containing train-oil fatty acids with a content of 10 to 60 per cent by weight of polyunsaturated fatty acids of chain lengths $C_{20}$ to $C_{24}$; the invention also relates to the manufacture of these liquid fatty acid esters and relates to partially or wholly sulfated products therefrom. More particularly the present invention is directed to fatty acid esters liquid at low temperature having the formula $$R_1-CO-O-(CH_2-\overset{\overset{\displaystyle R}{|}}{C}H-O)_n-CO-R_2$$

wherein $R_1$ — CO is the acyl of at least one fatty acid selected from the group consisting of (a) train-oil fatty acids and (b) liquid fatty acid mixtures containing train-oil fatty acids and containing from 10% to 60% by weight of polyunsaturated fatty acids having 20 to 24 carbon atoms, $CO—R_2$ is the acyl of at least one liquid fatty acid substantially free of any polyunsaturated train-oil fatty acids, and having more than 75% by weight of unsaturated fatty acids selected from the group consisting of (i) monounsaturated fatty acids having 10 to 22 carbon atoms (ii) diunsaturated fatty acids having 10 to 22 carbon atoms, and (iii) mixtures thereof, R is a member selected from the group consisting of hydrogen and methyl, and $n$ is an integer from 1 to 10, with the proviso that up to 20 mol per cent of either $R_1—CO$ or $CO—R_2$ can be replaced by hydrogen.

The present invention further provides a process for producing the above fatty acid esters liquid at low temperatures in which either (A) the fatty acid $R_1—COOH$ is adducted with 1 to 10 mols of the alkylene oxide and the esterified with the fatty acid $R_2—COOH$, or (B) the fatty acid $R_2—COOH$ is adducted with 1 to 10 mols of the alkylene oxide and then esterfied with the fatty acid $R_1—COOH$.

The present invention is further directed to a fat-liquoring agent selected from the group consisting of (a) from 0% to 100% by weight of the aforesaid liquor fatty acid esters, (b) from 0% to 100% by weight of the sulfation products of the aforesaid liquor fatty acid esters having a degree of sulfation of from 15% to 60%, and (c) from 0% to 100% by weight of the sulfonation products of the aforesaid liquid fatty acid esters having a degree of sulfonation of from 15% to 60%, with the proviso that the total of (a), (b), and (c) is 100% by weight.

The present invention is also directed to a fat-liquoring agent composition consisting essentially of (I) from 1% to 10% by weight of the fat liquoring agent described above, (II) from 0% to 10% by weight of a surfactant selected from the group consisting of an anionic surfactant, a nonionic surfactant, and the mixtures thereof, and (III) the balance of 100% by weight of water.

The present invention moreover provides an improvement in the process for fat-liquoring of leather comprising contacting leather with a fat-liquoring agent and recovering said fat-liquored leather; the improvement which comprises contacting said leather with the above-described fat-liquoring agent.

In the manufacture of the fatty acid alkylene oxide adducts, the starting material in case (A) above are train-oil fatty acids, in particular fish-oil fatty acids, such as those obtained from herring oil, menhaden oil or sardine oil. Such train-oil fatty acids contain from 10% to 60% by weight of polyunsaturated fatty acids having 20 to 24 carbon atoms, preferably having 20 to 22 carbon atoms. The number of double bonds in these fatty acids depends upon the origin of the train-oil; and there is on the average from 2.1 to 5.3 double bonds per fatty acid molecule. The remaining fatty acids of the mixture comprises 40% to 90% of a mixture comprising 65% to 100% by weight of monounsaturated and/or polyunsaturated fatty acids having 14 to 18 carbon atoms, such as alkenoic acids having 14 to 18 carbon atoms, for example oleic acid, alkadienoic acids having 14 to 18 carbon atoms, for example linoleic acid, and alkatrienoic acids having 14 to 18 carbon atoms, for example linolenic acid; and this mixture further comprises 0% to 35% by weight of saturated fatty acids having 10 to 22 carbon atoms, such as alkanoic acids having 10 to 22 carbon atoms. In regard to producing end products with a high resistance to low temperatures, it is desirable that the proportion of saturated fatty acids by as small as possible and should not exceed 35 percent by weight of the total fatty acid content. If necessary the proportion of solid fatty acids can be reduced by distillation or other known refining methods.

For the alkylene oxide addition it is also possible to use mixtures of train-oil fatty acids and other liquid fatty acids or mixtures of fatty acids, for example mixture of fatty acids obtained from vegetable or animal oils, as starting material, as long as the composition of the total fatty acid mixture remains within the specified limits.

The above-described train-oil fatty acids are reacted with 1 to 10 mols, preferably 2 to 4 mols, of ethylene oxide and/or propylene oxide per mol of fatty acid. The addition takes place in a known manner in the presence of alkaline catalysts, preferably under pressure and at elevated temperatures.

The train-oil fatty acid alkylene oxide adducts are further esterified with liquid fatty acids or fatty acid mixtures which have more than 75% and preferably more than 80%, by weight, of unsaturated fatty acids selected from the group consisting of monounsaturated fatty acids having 10 to 22 carbon atoms and diunsaturated fatty acids having 10 to 22 carbon atoms, and the mixtures thereof, which contain substantially no polyunsaturated train-oil fatty acids.

Suitable examples of these unsaturated fatty acids include alkenoic acids having 10 to 22 carbon atoms, for example olenic acid, gadoleic acid and erucic acid, alkadienoic acids having 10 to 22 carbon atoms, for example linoleic acid. Preferred fatty acid mixtures having 10 to 22 carbon atoms are those with major amounts of oleic, linoleic, gadoleic and/or erucic acid, as are obtained from naturally occurring fats such as beef tallow, lard, peanut oil, palm-kernal oil, rap oil, tall oil, etc.

It is also preferable to keep the proportion of saturated fatty acids having 10 to 22 carbon atoms, such as alkanoic acids having 10 to 22 carbon atoms as low as possible, for example less than 25% and preferably less than 20% by weight, if a good resistance to low temperatures is desired in the end products. Optionally, the saturated fatty acids portion may be separated from the liquid fatty acid by cold filtration, compressing, distillation or screening processes, whereby the residual amount of saturated fatty acids is less than 20 per cent by weight.

The esterification takes place according to known procedures in the presence of known catalysts, such as isopropyl titanate, stannous chloride, zinc dust, trisodium phosphate, tin power or the like, preferably at elevated temperatures under vacuum, while distilling off the water formed in the reaction. The molar ratios of the components range approximately from 0.8 : 1 to 1.2 : 1, preferably about 1 : 1, so that an esterification product results with an OH-value of below 30.

In case (B) the manufacture of the products takes place such that 1 to 10 mols of ethylene oxide and/or propylene oxide are initially adducted to the liquid fatty acids or fatty acid mixtures which are substantially free of train-oil fatty acids and subsequently the esterification is carried out subsequently with the train-oil fatty acids. The course of the process and the result correspond to the product manufactured according to (A).

In accordance with the process (A) or (B) uniformly structured fatty acid di-esters of polyoxyalkylene glycols having 2 and/or 3 carbon atoms are produced and are characterized in that they contain different fatty acid components within one molecule. They are thus distinguished in a characteristic manner from those polyoxyalkylene glycol fatty acid esters which are obtained by esterification of 1 mol of a polyoxyalkylene glycol with 2 mols of a mixture of corresponding fatty acids. Such mixed esters which contain the fatty acid residue in statistical distribution, have different, and for many applications less advantageous, properties.

The ester mixtures of the present invention are clear yellowish to brown oils which have good resistance to low temperatures.

Because of their high content of long-chain fatty acids they are excellent fat liquoring agents for leather and skins, and they can be used in place of the fish or whale oils not always available in constant quality and composition, or sperm oil, which is relatively expensive and not always available in sufficient quantitites.

The use of fat-liquoring agents for leather or skins can take place in an organic solvent, such as benzine, or chlorinated hydrocarbons, or as an aqueous emulsion with the addition of anionic or nonionic surfactants. Suitable examples of anionic surfactants are sulfates for example higher fatty alcohol sulfates or fatty alcohol polyalkylene oxide ether sulfates. Suitable examples or nonionic surfactants are ethylene oxide adducts on higher fatty alcohols, alkyl phenols, fatty amines, or fatty acid ethanolamides, which contain sufficient ethoxide units to be water soluble. The esterification products of the present invention may also be used in partially sulfated or sulfited form, for which purpose they are reacted in a known manner with technical sulfuric acid, oleum or with an air bisulfite mixture. The degree of sulfation or sulfonation ranges from about 15% to 60% of the available double bonds in the ester. The sulfonated esters can be used with emulsifiers or can be emulsified in water without further use of surfactants and utilized in this form for the fat-liquoring of leather and/or skins.

Suitable for use as fat-liquoring agents include (a) from 0% to 100% by weight of the liquid fatty acid esters themselves, (b) from 0% to 100% by weight of the sulfation products of these esters having a degree of sulfation of from 15% to 60%, and (c) from 0% to 100% by weight of the sulfonation products of these esters having a degree of sulfonation of from 15% to 60%, with the proviso that the total of (a), (b) and (c) is 100%.

Suitable fat-liquoring agent compositions include (I) from 1% to 10% by weight, preferably from 5% to 8% by weight, of the above-described fat-liquoring agent, said fat-liquoring agent preferably comprising from 70% to 100% by weight of one of the ester sulfonation product or the ester sulfation product and from 0% to 30% by weight of the ester itself; (II) from 0% to 10% by weight of an anionic surfactant or a nonionic surfactant and (III) the balance to 100% by weight of water.

The leathers fat-liquored with the products in accordance with the invention have a pleasant, oily handle and are of a relatively light color. The products of the invention thus surpass in their quality and properties the naturally occurring train-oil and the train-oil refined products, and correspond largely to sperm oil for which they represent an eminently suitable substitute.

The products can also be used advantageously as greasing and lubricating agents in other fields, e.g. as lubricants for textile fibers or for the achievement of special lubricating effects on metal surfaces.

The following examples are merely illustrative of the present invention without being deemed limitative in any manner thereof.

EXAMPLE 1

A mixture consisting of 2800 gm of the liquid portion of tallow fatty acids (technical oleic acid, acid value: 202; saponification value: 205; iodine value: 92) and 4130 gm of an addition product of 3 mols of ethylene oxide to one mol of fish-oil fatty acid (acid value: 0.9, saponification value: 121; iodine value: 73; OH value: 142) was heated with 7 gm of isopropyl titanate, with stirring, in a round-bottom flask, fitted with a distillation column, during a period of 8 hours from140° C up to 235° C under vacuum, with the vacuum being reduced with rising temperature from 100 mm to 30 mm Hg. After distilling off altogether 180 gm of the water of reaction, the esterification was completed. 6740 gm of a light brown, liquid ester remained (acid value: 2.1; saponification value: 168; iodine value: 83; OH value: 8). The turbidity point was −2° C.

EXAMPLE 2

500 gm of a mixture of talloleic acid and the fatty acid distillate from rape oil in a molar ratio of 1:1 (acid value: 192; saponification value: 195 : iodine value 115; resinic acid 0.6%), and 600 gm of an addition product of 2 mols of ethylene oxide on the fatty acid distillate from menhaden oil (acid value: 0.3; saponification value: 155; iodine value: 153; OH value: 161) were esterified in the presence of 2 gm of tin powder. The reaction was conducted at a vacuum pressure of 4 mm Hg and at a reaction temperature which was increased from 100° C up to 200° C during a period of 6 hours. After distilling off 32 gm of the water of reaction, and filtering off the catalyst, 1065 gm remained of a light-brown, liquid ester (acid value: 1.9; saponification value: 176; iodine value: 138; OH value: 17). The turbidity point was about 0° C.

EXAMPLE 3

Utilizing a procedure analogous to that described in Example 2, 300 gm of liquid constituents from a technical palm oil (acid value: 201; saponification value: 203; iodine value: 94; turbidity point: 6.5° C) were esterified with 395 gm of an addition product of 2 mols of propylene oxide per mol of a fatty acid mixture consisting of 30% of a fatty acid distillate from menhaden oil and 70% of a technical oleic acid (acid value: 1.4; saponification value: 117; iodine value: 92; OH value: 157) in the presence of 2 gm zinc oxide. After distilling off 19 gm of the water of reaction about 670 gm of a liquid ester (acid value: 0.7; saponification value: 163; iodine value: 92) were obtained. The turbidity point was at −10° C.

EXAMPLE 4

A mixture of the liquid esters prepared according to Example 1 was sulfited in a known manner at 70° C to 80° C with 14% by weight of sodium hydrogen sulfite by injecting air into the liquid, until the product was emulsifiable in water. The degree of sulfitation was about 25%.

Chrome-tanned suede leather for clothing, retanned in the usual manner with synthetic tanning agents, was fat-liquored in the usual manner at 60° C for 45 minutes with a fat-liquoring agent composition containing 6% to 8% of a mixture consisting of 95% of the above sulfited product, and 5% of an adduct of 8 mols ethylene oxide on a mixture of fatty alcohols having 12 to 18 carbon atoms. The balance to 100% by weight was water. The leather was contacted with 100% liquor, and then dried and finished. A cloth-like soft, full, clothing leather of good handle was obtained.

EXAMPLE 5

A mixture of liquor esters prepared according to Example 2 was sulfated in a known manner with 18% oleum and neutralized with an aqueous 5% solution of ammonia. After separation of the resulting salt water solution, enough water was added to adjust the content of the fat-liquoring agent to about 80 percent by weight.

Chrome-tanned upper leathers, retanned with vegetable tanning agents were fat-liquored at 50° C to 60° C for 45 minutes with a fat-liquoring agent composition containing from 5% to 6% of a fat-liquoring agent mixture containing 70% of the sulfated ester product and 30% of the corresponding non-sulfated ester. The balance of 100% by weight was water. The leather was contacted with 100% liquor, dried in the known manner and finished. A full, soft upper leather with good handle was obtained.

EXAMPLE 6

An esterification product prepared according to Example 3 was sulfated as described in Example 5, neutralized with ammonia water and adjusted to about 80 percent by weight of fat-liquoring agent. Chrome-tanned upper leathers retanned with synthetic tanning agents, were fat-liquored at 60° C for 45 minutes with a fat-liquoring agent composition containing 5% to 6% of a fat-liquoring agent mixture containing 70% of the sulfated ester product and 30% of the corresponding non-sulfated ester. The balance of 100% by weight was water. The leather was contacted with 100% liquor, dried and finished. A full, soft upper leather of good handle was obtained.

EXAMPLE 7

Utilizing a procedure analogous to that described in Example 1, 560 gm of a fish-oil distillation fatty acid (acid value 197; saponification value: 200; iodine value: 140) were esterified with 850 gm of an addition product of 3 mols of propylene oxide on one mole of the liquid constituents of a peanut oil distillation fatty acid (acid value: 0; saponification value: 120; iodine value: 59; OH value: 131) in the presence of 4 gm of stannous chloride. After distilling off 37 gm of the water of reaction, 1370 gm of liquid ester were obtained (acid value; 1.2; saponification value: 155; iodine value: 71; OH value: 19) which even at 0° C did not separate out any solid constituents.

Although the present invention has been disclosed in connection with a few preferred embodiments thereof, variations and modifications may be restored to by those skilled in the art without departing from the principles of the new invention. All of these variations and modifications are considered to be within the true spirit and scope of the present invention as disclosed in the foregoing description and defined by the appended claims.

We claim:

1. A fat-liquoring agent selected from the group consisting of (a) from 0% to 100% by weight of fatty acid esters liquid at low temperatures having the formula $$R_1-CO-O-(CH_2-\overset{\overset{\displaystyle R}{|}}{C}H-O)_n-CO-R_2$$

wherein $R_1$—CO is the acyl of at least one fatty acid selected from the group consisting of (a) train-oil fatty acids and (b) liquid fatty acid mixtures containing train-oil fatty acids and containing from 10% to 60% by weight of polyunsaturated fatty acids having 20 to 24 carbon atoms, CO—$R_2$ is the acyl of at least one liquid fatty acid substantially free of any polyunsaturated train-oil fatty acids and having more than 75% by weight of unsaturated fatty acids selected from the group consisting of (i) monounsaturated fatty acids having 10 to 22 carbon atoms (ii) diunsaturated fatty acids having 10 to 22 carbon atoms, and (iii) mixtures thereof, R is a member selected from the group consisting of hydrogen and methyl, and *n* is an integer from 1 to 10, with the proviso that up to 20 mol percent of either $R_1$—CO or CO—$R_2$ can be replaced by hydrogen, (b) from 0% to 100% by weight of the sulfation products of said liquid fatty acid esters having a degree of sulfation of from 15% to 60%, and (c) from 0% to 100% by weight of the sulfonation products of said liquid fatty acid esters having a degree of sulfonation of from 15% to 60%, with the proviso that the total of (a), (b), and (c) is 100% by weight.

2. A fat-liquoring agent composition consisting essentially of (I) from 1% to 10% by weight of the fat-liquoring agent of claim 1, (II) from 0% to 10% by weight of a surfactant selected from the group consisting of an anionic surfactant, a nonionic surfactant, and the mixtures thereof, and (III) the balance of 100% by weight of water.

3. The fat-liquoring agent composition of claim 2, which consists essentially of (I) from 5% to 8% by weight of a fat-liquoring agent which consists of (A) from 70% to 100% by weight of a member selected from the group consisting of said sulfation product, said sulfonation product and the mixtures thereof, and (B) from 0% to 30% by weight of said liquid fatty acid ester; (II) from 0% to 10% by weight of said surfactant; and (III) the balance of 100% by weight of water.

4. In the process for fat-liquoring of leather comprising contacting tanned leather or skins with a fat-liquoring agent and recovering said fat-liquored leather or skins; the improvement which comprises contacting said leather or skins with the fat-liquoring agent of claim 1.

5. The fat-liquoring agent of claim 1 containing at least 70% by weight of compounds selected from the group consisting of said component (b), said component (c) and mixtures of said components (b) and (c).

6. The fat-liquoring agent of claim 1 wherein *n* is an integer from 2 to 4.

7. The fat-liquoring agent of claim 1 wherein the fatty acids of the acyl $R_1$—CO contain on an average from 2.1 to 5.3 double bond per fatty acid molecule.

8. The fat-liquoring agent of claim 1 where the $R_1$—CO of (b) is the acyl of fatty acid mixtures consisting essentially of (j) from 10% to 60% by weight of polyunsaturated fatty acids having 20 to 24 carbon atoms and (jj) from 40% to 90% by weight of fatty acids consisting essentially of (aa) from 65% to 100% by weight of unsaturated fatty acids selected from the group consisting of monounsaturated fatty acids having 14 to 18 carbon atoms, polyunsaturated fatty acids having 14 to 18 carbon atoms and mixtures thereof and (bb) from 0% to 35% by weight of saturated fatty acids having 10 to 22 carbon atoms.

9. The fat-liquoring agent of claim 1 wherein CO—$R_2$ is the acyl of at least one liquid fatty acid containing a major amount of an unsaturated fatty acid selected from the group consisting of oleic acid, linoleic acid, gadoleic acid, erucic acid and the mixtures thereof.

10. The fat-liquoring agent of claim 1 wherein said $R_1$—CO is the acyl of at least one fatty acid obtained from a fish-oil selected from the group consisting of herring oil, menhaden oil and sardine oil.

* * * * *